United States Patent [19]

David

[11] 4,086,030

[45] Apr. 25, 1978

[54] FREE FLUID-OPERATED WELL TURBOPUMP

[75] Inventor: Ed B. David, Benton, Ark.

[73] Assignee: EMC Energies, Inc., Mills, Wyo.

[21] Appl. No.: 732,672

[22] Filed: Oct. 15, 1976

Related U.S. Application Data

[62] Division of Ser. No. 548,860, Feb. 10, 1975, Pat. No. 4,003,678.

[51] Int. Cl.[2] ..... F04B 23/04

[52] U.S. Cl. ..... 417/88; 417/406; 417/408

[58] Field of Search ..... 415/501; 417/88, 91, 417/406, 408

[56] References Cited

U.S. PATENT DOCUMENTS

| | | | |
|---|---|---|---|
| 1,818,455 | 8/1931 | Bigelow | 417/88 |
| 2,733,663 | 2/1956 | Marshall | 417/406 |
| 3,143,078 | 8/1964 | Gaslow et al. | 417/406 |
| 3,171,355 | 3/1965 | Harris et al. | 417/406 |
| 3,171,630 | 3/1965 | Harney et al. | 415/501 |
| 3,758,238 | 9/1973 | Erickson et al. | 417/408 |
| 4,003,678 | 1/1977 | David | 417/408 |

*Primary Examiner*—C. J. Husar
*Attorney, Agent, or Firm*—Ralph R. Pittman

[57] ABSTRACT

A fluid-operated turbopump, suitable for installation in the bottom hole tubing of an oil well, is structurally adapted as a hydraulically insertable and removable unit. The turbopump has axially spaced rotary driving and driven impellers operable for overbalancing columns of fluid which are separated by the wall of the tubing, the overbalancing operation facilitating upward movement of fluid from an underground production zone to aboveground storage. A tubular drive shaft interconnecting the impellers is utilized to convey fluid axially through the driven impeller.

8 Claims, 10 Drawing Figures

FREE FLUID-OPERATED WELL TURBOPUMP

BACKGROUND

This application is a division of my prior application Ser. No. 548,860, filed Feb. 10, 1975, now U.S. Pat. No. 4,003,678 dated Jan. 18, 1977 both applications relating to oil well pumping equipment.

A large variety of fluid operated pumps, some of which embody axially spaced driving turbine and driven pump impellers, have been described in the prior art, those pumps suitable for bottom hole operation usually requiring somewhat complex mechanical structures. In general, the complexity of these mechanisms is found in the structures utilized to secure the moving pump members within the necessarily limited tubing size, while at the same time finding room for the fluid passageways needed for moving fluid upwardly through or, more often, around the pump members. More particularly, the fluid passageways are often so located and of such configuration as to impede, rather than to facilitate the upward movement of fluid from a production zone.

SUMMARY OF THE INVENTION

The turbopump described herein has a hydraulically operated driving turbine axially spaced from a driven pump, each having a single impeller, the impellers being rigidly mechanically joined by an axially extending drive shaft. The turbopump is constructed for pumping down into or up out of the tubing string of an oil well.

A bypass structure in the turbopump assures that the driving fluid, which may be crude oil, is mingled with pumped production fluid only after its passage through within the driving turbine. A coaxial bore through a portion of the revoluble drive shaft is employed as a conduit in the bypass structure, inwardly directed fluid openings through the conduit wall of the shaft being contoured to so deflect the inwardly moving fluid from a radial direction as to augment the turning moment of the driving impeller. Similarly, the entrance ports for conducting pressurized driving fluid through the top of the driving turbine housing for impingement upon the driving impeller are also oriented to direct the driving fluid to the turbine blades at the angle to yield the maximum torque under the prevailing conditions of volume and pressure.

A jet-venturi structure is positioned at the discharge end of the turbopump. At this location the spent driving fluid is discharged from the lower end of the hollow portion of the drive shaft through a jet nozzle into the throat of a coaxially disposed venturi tube. A pair of sloped production fluid passageways in the structure concurrently direct production fluid into the throat of the venturi, the spent driving fluid and the pumped production fluid mixing at this location, the blend exiting via the end bell of the venturi. The fluid driven from the jet nozzle reacts with the venturi to lower the heat against which the production fluid moves, assisting the bottom hole pressure in moving fluid upwardly through the turbopump and reducing the head against which the driven pump impeller works.

The invention is adapted for service as an insert or "free" turbopump, being sized for hydraulic installation and removal without pulling the tubing in which it operates. A turbopump-receiving chamber is provided at the bottom end of the tubing and a check valve mounted in the tubing at the upper end of the turbopump, the latter being oriented to discharge first downwardly and thence laterally into an annular space between the well casing and the tubing.

DESCRIPTION OF THE PREFERRED EMBODIMENT

Figure 1:
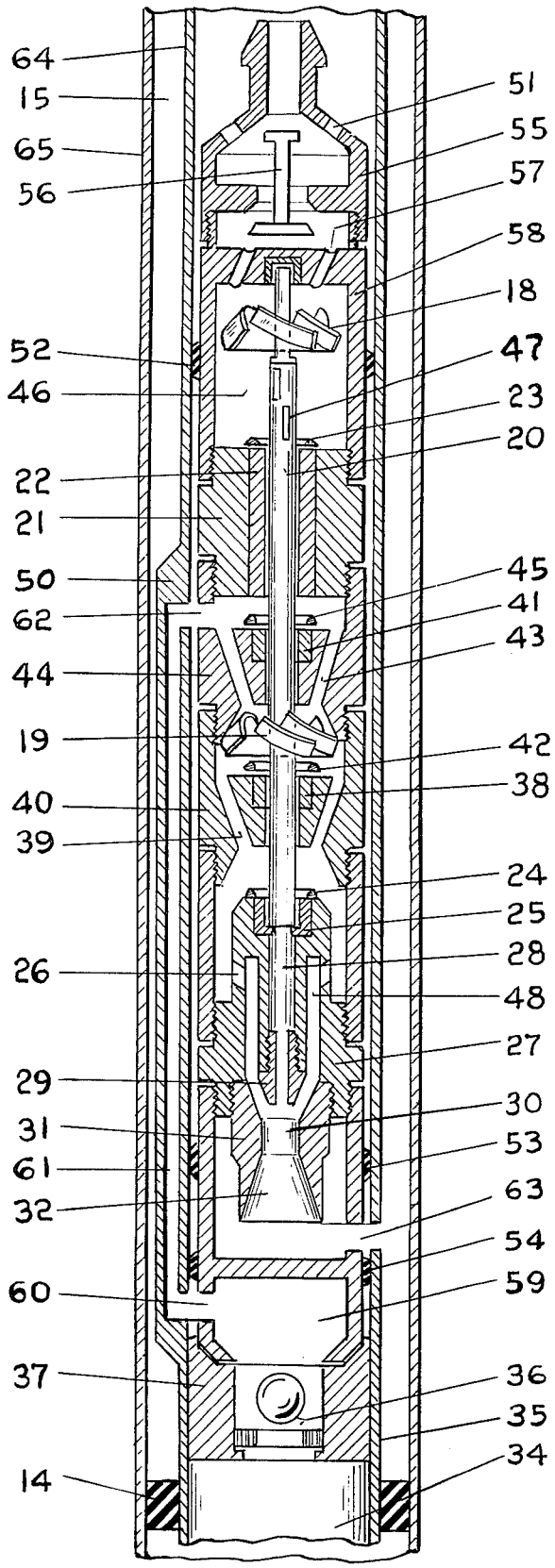
FIG. 1 is an elevation — principally in section except for a diagrammatic view of the bypass member 27 — of a turbine driven pump assembly embodying the invention and illustrating its installation within a typical oil well casing.
Figure 10:
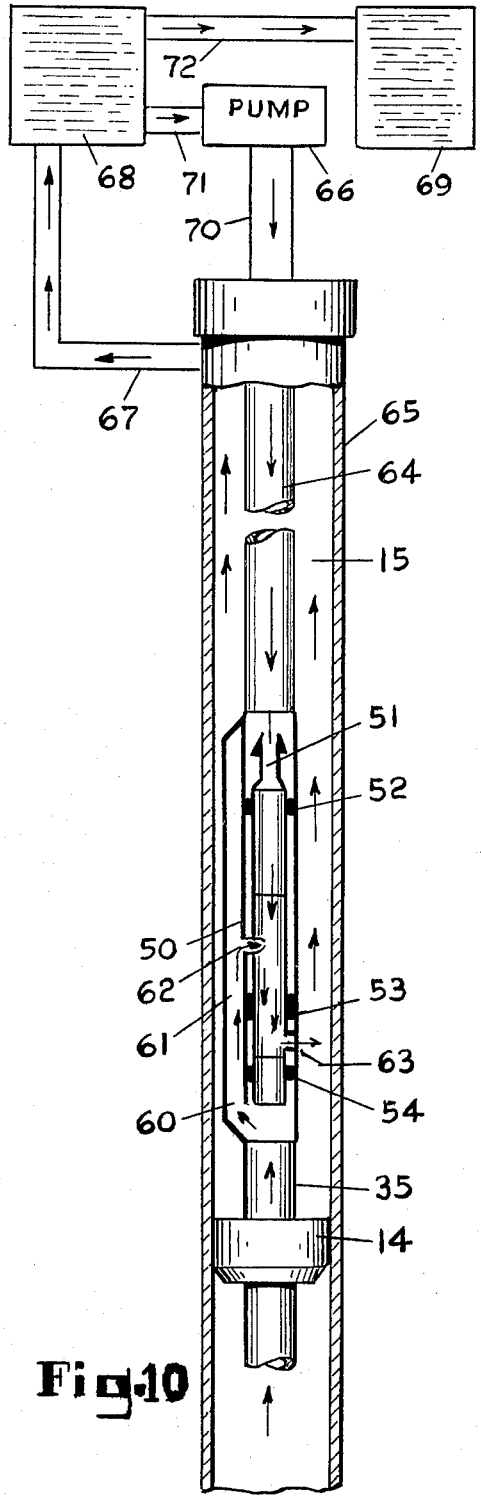
FIG. 10 is a diagrammatic elevation of the turbopump in a well along with the above ground accessories, the arrows indicating direction of fluid movement under production fluid pumping conditions. As shown, the driving fluid actuating the turbopump moves downwardly through the tubing, and a blend of production and spent driving fluid moves upwardly through an annular space between the casing and the tubing.

The invention, shown in the assembly drawing of FIG. 1 and the diagrammatic illustration at FIG. 10, is a hydraulically operated turbopump adapted for removable positioning in a production zone at the lower end of an oil well tubing string. Both the tubing 64 and the annular space 15 between the tubing 64 and the well casing 65 are utilized as passageways for fluid movement.

The turbopump is actuated by the movement of a pump-actuating fluid supplied from accessary surface facilities, the spent fluid, after passing through the driving turbine, moving downwardly through the bore of a drive shaft to mix with pumped production fluid, the admixture then moving upwardly through the annular space to aboveground storage tanks.

As may be seen in FIGS. 1 and 10, the oil well casing 65 contains the coextensive tubing 64 within the annular space 15, and as is common in "free" standing pumps, an enlarged bottom hole pump-receiving compartment 50 is secured at the lower end of the tubing. The bottom hole assembly also includes the production packer portion 35 and associated opening 34 for receiving the standing valve 37 and valve closure ball 36, the production packer ring 14 sealing the annular space 15 against entrance of production fluid.

The turbopump is an elongated cylindrical mechanism having an outside diameter less than the inside diameter of the well tubing in which it is placed, and is sealed in place by the longitudinally spaced annular resilient ring members 52, 53 and 54 while resting on the bottom hole standing valve 37.

Figure 9:
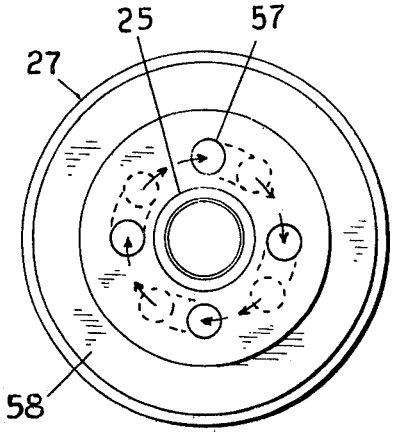
FIG. 9 is a plan view of the housing of the driving turbine, showing the directional ports through the top of the housing.

The upper end of the turbopump is provided with a check valve chamber 55 and the associated reciprocably movable closure disk 56 and the entrance ports 51. The valve chamber is threadedly joined to the coextensive driving turbine housing 58, through the upper end closure of which the contoured fluid-directing ports 57 extend (FIG. 9).

Figure 7:
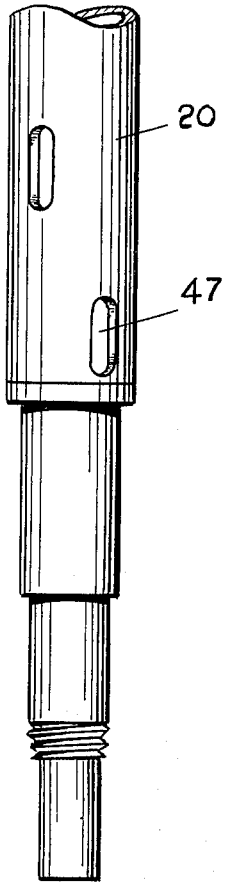
FIG. 7 is a fragmentary view of the drive shaft which connects the driving turbine to the driven pump, showing the fluid-directing passageways through the wall of the hollow portion of the shaft.
Figure 6:
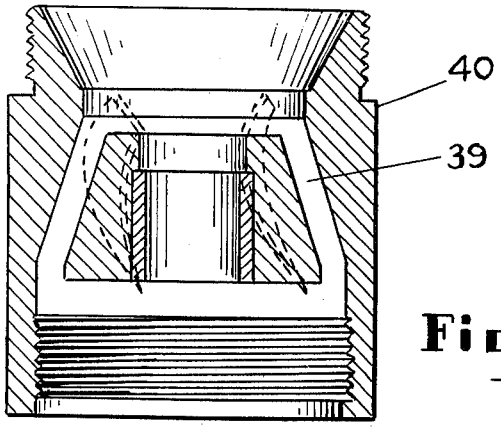
FIG. 6 is a sectional view of the lower bowl of the driven pump.

The turbine impeller 18 is mounted for rotation with the vertical drive shaft 20. The drive shaft has an upper solid portion passing coaxially upward through the turbine impeller 18 to an upper bearing and a downwardly extending hollow portion coextensively joined to the lower end of the solid portion at an elevation within the turbine intermediate chamber 46, there being within the chamber a plurality of slots 47 (FIG. 7) through the wall of the hollow portion of the shaft.

Figure 5:
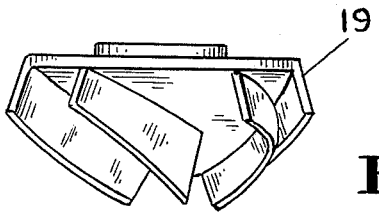
FIG. 5 is an elevational view of the driven pump impeller.

The main bearing housing 21 is secured at the lower end of the turbine housing, coextensively therewith and containing the main drive shaft bearing 22, a sand shield 23 being mounted at the upper end of the main bearing. The upper pump bowl housing 44 is coextensively joined to the lower end of the bearing housing 21 and in turn the lower pump bowl housing 40 is similarly secured to the lower end of the upper pump bowl housing 44, the bowl housings providing a chamber in which the axially disposed pump impeller 19 (FIG. 5) may rotate, the latter being rigidly secured to the hollow portion of the drive shaft 20 which extends coaxially therethrough.

The drive shaft 20 terminates at its lower end at the lower bearing 25 and associated sand shield 24 in an upper end portion of the coaxially aligned bypass member 27, and the alignment of the drive shaft 20 is assured by the intermediate bearings 38 and 41 and the associated sand shields 42 and 45.

Figure 4:
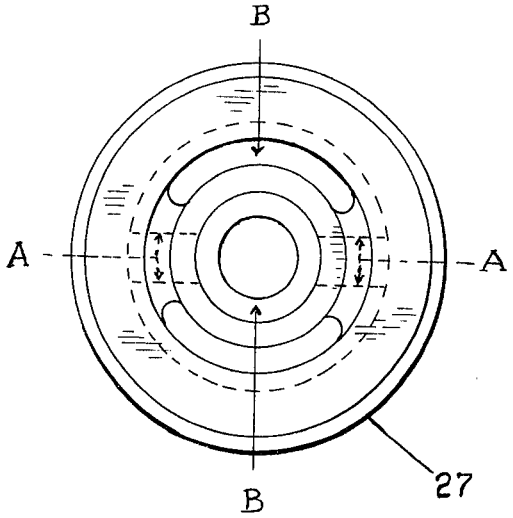
FIG. 4 is a plan view of the bypass member, for the purpose of showing the absence of any connection between the vertical and transversely extending passageways.
Figure 3:
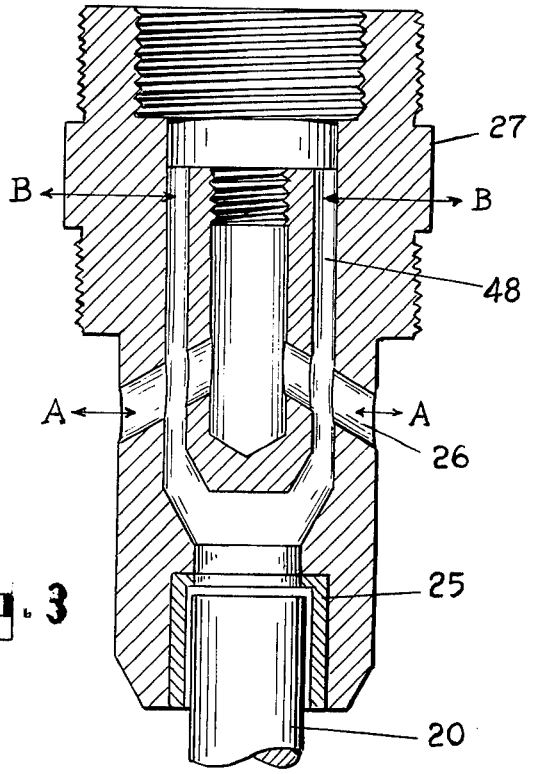
FIG. 3 is a fragmentary diagrammatic view, principally in section, of the fluid bypass member, which also appears inverted in the FIG. 1 assembly.
Figure 8:
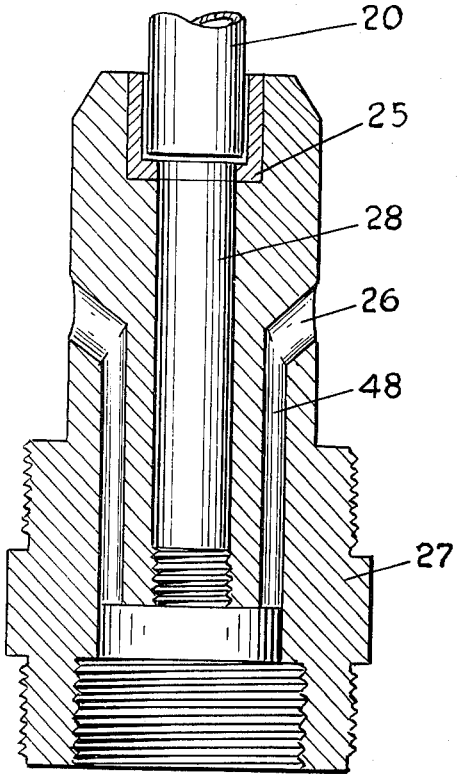
FIG. 8 is a sectional elevation of the fluid-aggregating bypass mixing chamber forming a portion of the discharge path from the lower and driven pump.

The bypass mixing and aggregating member 27 (FIGS. 3 and 8) has formed therein a pair of laterally disposed, downwardly directed passageways 48 (noted as "B" in FIGS. 3 and 4) and also a pair of separated diametrically opposed, transversely sloped ports 26 (noted as "A" in FIGS. 3 and 4). The upper central cylindrical portion 28 of the bypass member 27 is coextensively disposed with the lower open end of the drive shaft 20, and the downwardly tapered nozzle 29 is threadedly joined to the lower end of the portion 28 of the bypass 27.

Figure 2:
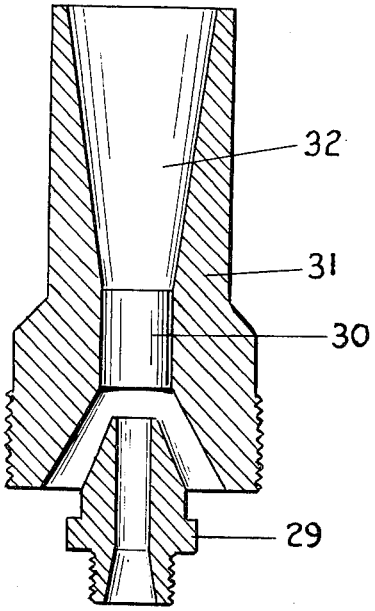
FIG. 2 is a fragmentary sectional view illustrating the venturi tube and the associated jet nozzle construction at the discharge end of the turbopump, these elements appearing in inverted position in FIG. 1.

The venturi 31 (FIG. 2) is secured to the lower end of the bypass 27, the throat 30 being in spaced alignment with the nozzle 29 and the bell end 32 communicating with the opening 63 to the annular space 15.

An upwardly extending production fluid channel 61 is provided along the pump-receiving portion of the lower tubing compartment 50, the channel 61 connecting the lower production fluid chamber 59 through the lower opening 60 and the upper opening 62 to the intake and discharge channels 43 and 39 in the upper and lower pump bowl housings 44 and 40, the intake and discharge channels leading to and from the pump impeller 19.

For normal pumping operation the annular space 15 and the tubing 64 are filled with driving fluid from the driving fluid storage tank 68 and the connecting pipeline 67, the resulting columns of liquid being hydraulically balanced. The introduction of additional driving fluid through the pipeline 70 into the tubing from the pump 66 effects rotation of the impellers 18 and 19 and delivery of production fluid from the production zone to the surface.

In so doing, the driving fluid enters the top of the turbopump through the upper ports 51 in the check valve chamber 55, the annular resilient seal 52 blocking the passage of driving fluid below the seal in the space between the driving turbine housing 58 and the inner surface of the tubing 64. The driving fluid in the valve chamber 55 moves the check valve disk 56 to the open position, permitting the driving fluid to move through and thereby be directionally oriented by the ports 57, the fluid impacting the upper turbine impeller blades in the direction to yield the maximum torque available from the driving fluid delivery.

The spent driving fluid moving from the impeller 18 leaves the intermediate chamber 46 through the contoured slots 47 and into the bore of the lower and hollow portion of the shaft 20. The slots 47 are shaped to direct the moving fluid into the shaft tangentially along the inner surface thereof to add an increment of turning moment to the shaft in the direction it is rotated by the reaction of the driving fluid on the impeller 18.

After passage downward through the bore of the shaft the spent driving fluid moves into the inner chamber 28 of the bypass aggregating member 27. The spent driving fluid is then jetted through the restricted jet nozzle 29 into the throat 30 of the venturi 31, and from the venturi through the port 63 to the annular space 15, the seals 53 and 54 precluding entrance of the downstream driving fluid to the space between the turbopump and the tubing from which it is suspended.

The production packer sealing ring 14 prevents the entrance of production fluid into the annular space 15, and in response to the overbalancing of the hydraulic head therein production fluid moves upward through the ball valve 37 into the production chamber 59, thence outwardly through the lower port 60, upwardly through the bypass channel 61 and inwardly through the port 62 to the upper bowl 44 of the driven pump.

The inlet channels 43 in the upper bowl 44 direct the production fluid to the lower impeller 19, and the production fluid is driven downward through the discharge channels 39 in the lower pump bowl 40, the tapered thrust bearing 24 shielding the bearing 25 against entrance of production sand.

The discharge channels 39 communicate with the sloping ports 26, which direct the production fluid downward through the passageways 48 to comingle with the spent driving fluid discharging from the jet nozzle 29 within the throat 30 of the belled end 32 of the aggregating venturi 31.

The blend of production fluid and spent driving fluid exits from the driven pump through the discharge opening 63 which opens laterally to the annular space 15, and thence upwardly through the discharge pipeline 67 to the driving fluid storage tank 68. All production fluid which is not repumped through the pump suction pipeline 71 is delivered to the production storage tank via the pipeline 72.

The turbopump may be removed from the well for inspection or repair by rearranging the surface pipeline connections to pump fluid downwardly into the annular space 15. The fluid so pumped enters the turbopump through the opening 63 and the upward movement of the fluid through the turbopump effects closure of the disk 56 of the check valve 55, following which action the hydraulic pressure lifts the turbo pump to the top of the tubing.

To either install or reinstall the turbopump in the well, the longitudinally spaced resilient ring seals 52, 53 and 54 are secured in place and the turbopump inserted into the upper end of the well tubing. Fluid is then pumped into the tubing above the turbopump, hydraulically driving it down through the tubing until it seats in place on the bottom hole ball valve 37.

What is claimed is:

1. In a fluid operated pumping system for use with an oil well having an outer tubular casing set in the well and an inner tubing within the casing radially spaced therefrom to define an annular passageway therebetween, a turbopump movable through said tubing from ground surface to an operating position at the lower end of said tubing, said turbopump comprising:

an upper driving turbine having a housing and an impeller therein, a lower driven pump having a pump impeller, and an axially disposed drive shaft connecting said impellers, said drive shaft having a solid end portion passing upwardly through said turbine impeller and an open end tubular portion passing from within said turbine housing downwardly through said pump impeller, a production fluid inlet at the lower end of said pump, driving fluid intake openings in said housing above said turbine impeller for delivering driving fluid thereto from said inner tubing, a production fluid intake for conveying production fluid upwardly to said pump impeller from said inlet and a production fluid discharge channel extending downwardly from said pump impeller in communication with said annular passageway, and a plurality of peripherally spaced openings through the wall of that portion of the tubular portion of said shaft located within said turbine housing, said tubular portion of said shaft providing a segment of a spent fluid passageway communicating with said annular passageway.

2. The pumping system as claimed in claim 1, in which said spent fluid passageway includes a jet nozzle and a serially related venturi mounted between the open end of said drive shaft and said annular space, and said production fluid discharge channel includes passages terminating at the throat of said venturi.

3. The pumping system according to claim 1, wherein the lateral sides of the openings through the wall of the drive shaft lie in planes defining an angle with respect to a radius of the circle of rotation of said turbine impeller.

4. The pumping system as defined in claim 1, wherein said peripherally spaced openings through the wall of said tubular portion of the drive shaft are structured to impart a turning moment to said shaft in the direction of rotation of said turbine impeller concurrent with the occurrence of fluid movement through said openings.

5. A fluid operated oil well turbopump adapted for removable placement within a bottom hole portion of a tubing of an oil well and for operation by means of pressurized driving fluid circulating from an aboveground source downwardly through the tubing and upwardly through an annular space between the tubing an a casing of the well, said turbopump comprising:

an upper driving turbine and an axially spaced lower driven pump each including a housing containing a revoluble impeller, a drive shaft extending coaxially through each of said impellers, said drive shaft having a solid portion secured to the turbine impeller and a coextensive tubular portion secured to and extending beyond the pump impeller, the solid portion merging with the tubular portion at a junction located between said impellers, said tubular portion of said shaft being closed at the junction end and open at the lower end and having a plurality of peripherally spaced intake openings apertured through the wall at a location within the turbine housing, a production fluid intake channel extending upwardly from the lower end of said tubing in communication with said pump impeller and a production fluid discharge channel extending downwardly from said pump impeller to a laterally extending opening connecting said tubing to said annular space, downwardly sloping openings in the top of said turbine housing effective to direct pressurized driving fluid from the upper end of said tubing to impingement on said turbine impeller, and a spent driving fluid passageway extending coaxially downward through said pump impeller from said turbine housing to said laterally extending opening connecting said tubing to said annular space, said spent driving fluid passageway including the tubular portion of said drive shaft.

6. The turbopump according to claim 5, wherein the upper end of said production intake channel terminates at an elevation above said pump impeller.

7. The turbopump as set forth in claim 5, in which a jet nozzle and a serially related venturi are coextensively mounted at the lower open end of said tubular portion of said drive shaft and the production fluid discharge channel includes a pair of channels terminating in the throat of said venturi.

8. The turbopump claimed in claim 5, including a check valve portion closed only to fluid passing upwardly through the turbopump, said check valve portion being positioned at the upper end of said turbopump.

* * * * *